US006696675B2

(12) United States Patent
Morrison

(10) Patent No.: US 6,696,675 B2
(45) **Date of Patent: *Feb. 24, 2004**

(54) INDUCTION HEATING SYSTEM FOR INTERNAL COMBUSTION ENGINE

(75) Inventor: William Adam Morrison, Boaz, AL (US)

(73) Assignee: Tocco, Inc., Boaz, AL (US)

( * ) Notice: Subject to any disclaimer, the term of this patent is extended or adjusted under 35 U.S.C. 154(b) by 159 days.

This patent is subject to a terminal disclaimer.

(21) Appl. No.: 09/925,408

(22) Filed: Aug. 10, 2001

(65) Prior Publication Data

US 2003/0111461 A1 Jun. 19, 2003

(51) Int. Cl.[7] ..... H05B 6/06; H05B 6/10; F02M 27/04

(52) U.S. Cl. ..... 219/661; 219/663; 219/635; 322/32; 363/21; 363/97; 123/549

(58) Field of Search ..... 219/661, 663, 219/635, 601, 660, 628, 677; 322/32, 333, 34, 29; 363/21, 97, 98, 131; 123/549, 543, 220

(56) References Cited

U.S. PATENT DOCUMENTS 3,581,489 A * 6/1971 Camin et al. ..... 60/30
4,862,858 A * 9/1989 Goldsberry ..... 123/538
5,622,643 A * 4/1997 Morizot ..... 219/665
5,841,646 A * 11/1998 Cornec ..... 363/98
6,018,154 A * 1/2000 Izaki et al. ..... 219/661
6,237,576 B1 5/2001 Buccino et al.

FOREIGN PATENT DOCUMENTS

JP 57-151021 * 9/1982 ..... 123/568.29
JP 10272153 4/2000
JP 2001-100586 * 4/2000
WO WO 98/25014 6/1998
WO WO 99/67873 * 12/1999

* cited by examiner

*Primary Examiner*—Philip H. Leung
(74) *Attorney, Agent, or Firm*—Fay, Sharpe, Fagan, Minnich & McKee

(57) ABSTRACT

A compact induction heating system for use on an internal combustion engine driven implement having an engine driven alternator to generate DC current for storage in a battery used as a source of clean DC current of less than 50 volts for ignition of fuel in the engine, the system comprises a high frequency inverter with an input connected to the clean DC current source, a first current conductive path including a first capacitor and a first switch closed to cause DC current to flow in the first path and across the first capacitor, a second current conductive path including a second capacitor and a second switch closed to cause DC current to flow in the second path and across the second capacitor, a single load inductor in both of the paths with DC current flowing in a first direction through the inductor when the first switch is closed and in a second opposite direction through the inductor when the second switch is closed and a gating circuit to alternately close the switches at a driven frequency to control heating by the load inductor.

27 Claims, 2 Drawing Sheets

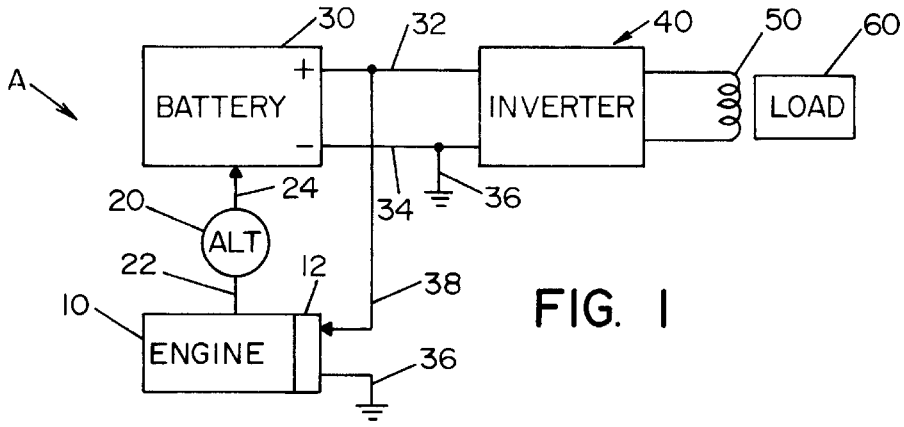
FIG. 1
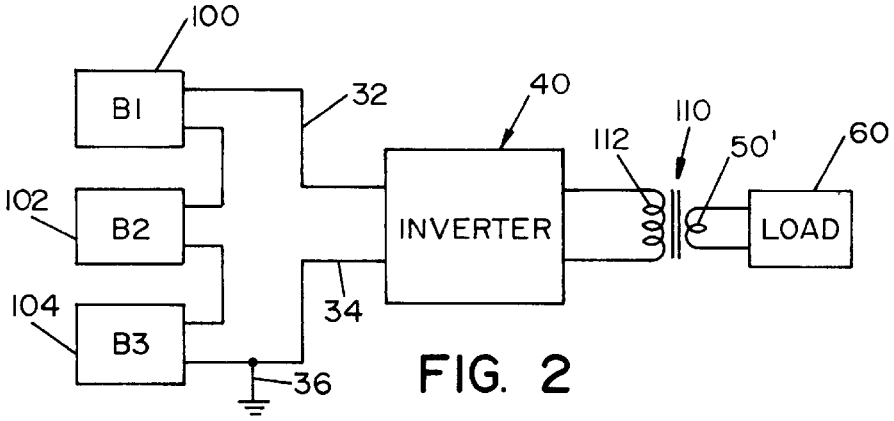
FIG. 2
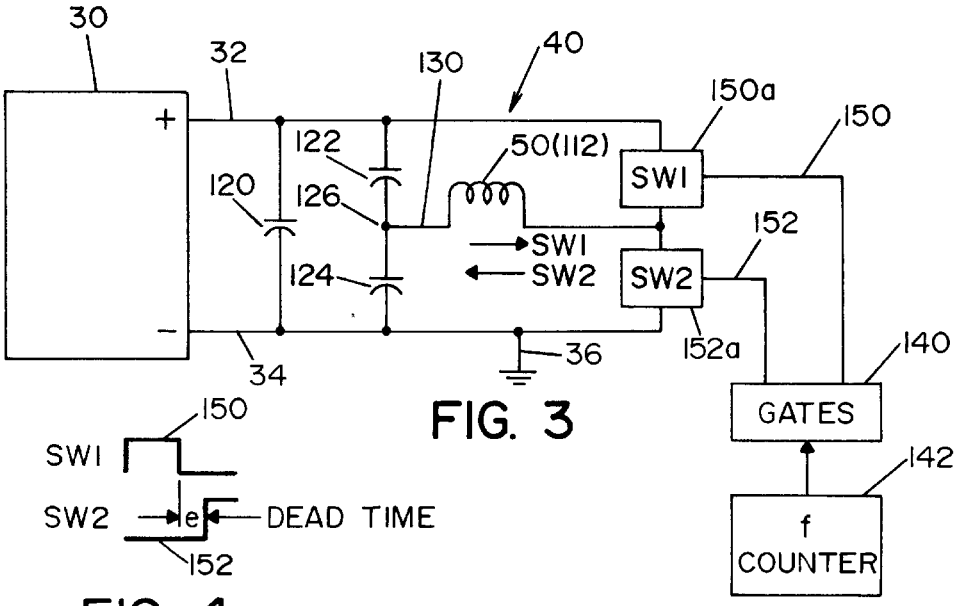
FIG. 3
FIG. 4

INDUCTION HEATING SYSTEM FOR INTERNAL COMBUSTION ENGINE

The present invention relates to the art of induction heating and more particularly to a unique compact induction heating system for use under the hood or cowling of internal combustion engine drive implement.

BACKGROUND OF THE INVENTION

Induction heating involves the use of an induction heating coil that is driven by alternating currents to induce voltage and thus current flow in a work piece encircled by or associated with the induction heating coil. Such technology has distinct advantages over convection heating, radiant heating and conduction heating in that it does not require physical contact with the heated work piece or circulating gasses to convey combustion type heat energy to the work piece. Consequently, induction heating is clean, highly efficient and usable in diverse environments. However, induction heating by work piece associated conductors normally involve power supplies connected to an AC line current. Such heating power supplies are constrained by the frequency of the incoming line. In some instances, the line voltage is three phase, which is rectified to produce a DC link and then converted to alternating current by use of an inverter.

Such DC link driven power supplies have two distinct disadvantages. They are relatively large and involve a heavy core that constitutes a major component of the input rectifier. Consequently, such power supplies cannot be fit into a small compartment, such as the area under the hood of a motor vehicle. Further, a heating system to be used in association with an internal combustion engine cannot involve induction heating since there is no source of alternating current to drive the power supply for the induction heating coil.

THE INVENTION

The present invention overcomes the disadvantages associated with existing induction heating systems, wherein the system can be made quite compact so that it is capable of being located in a small compartment, such as the under hood of a motor vehicle or other internal combustion engine driven implements.

The present invention utilizes a compact inverter having a clean DC input and components which fit into a relatively small housing with a volume of less than about 100 cubic inches. By developing a special induction heating system for use in a confined space, the advantages of induction heating can be employed for various heating functions, in such confined space as under the hood of a motor vehicle. Consequently, the required heating operations in such a confined space can enjoy the advantages of induction heating with its efficiency, environmental friendly nature, and ease of control.

In accordance with the present invention, there is provided a compact induction heating system for use on an internal combustion engine driven implement having an engine driven alternator to generate DC current for storage in a battery used as a source of clean DC current of less than 50 volts for ignition of fuel in the engine. The system comprises a high frequency inverter with an input connected to the clean DC source. A pair of identical AC tuning capacitors are connected in series across the clean DC source. Each capacitor is initially charged to one half the input DC voltage. The load inductor is connected at one end to the center junction of the two AC capacitors. A pair of solid state switches (i.e. IGBT transistors) are also connected in series across the clean DC source and in parallel with the two series AC capacitors. The other end of the inductor is connected to the center junction of the two switches. The switches are opened and closed (gated on and off) alternately at a frequency determined by the application (typically between 10 kHz and 20 kHz, but with a range capability of 1 kHz to 200 kHz). The frequency of the gates is equal to the natural resonant frequency of the load. The power or the amount of heat generated can be varied by slightly adjusting the gating frequency above or below the natural resonant frequency of the load. When the first switch closes, the voltage stored in the first AC capacitor is discharged through the inductor, producing one half of the AC sinusoidal current, and back to the opposite polarity of the clean DC source. At the same time, the first capacitor is then charged to the full potential of the clean DC source. The switch is then opened (turned off), and after a sufficient amount of dead time has elapsed, the second switch is turned on. When the second switch is closed, the second AC capacitor then discharges through the inductor, producing the other half of the AC sinusoidal current, and is then charged to the full potential of the clean DC source, but in the opposite polarity of the other capacitor. This process is then repeated as long as the gate signals are present. The subsequent cycles after the first cycle differ in the fact that the AC tuning capacitors are now charged to the full potential of the clean DC input. The process is halted when the gating signals are removed or disabled. The AC current generated by the capacitor-transistor switching system (inverter) is passed though the inductor. This current induces a voltage within the part/workpiece to be heated (via magnetic flux). The induced voltage develops a current within the part which meets resistance to the material which comprises the part. This resistance to current flow generates heat in the form of $I^2R$ losses, where (I) is the induced current and (R) is the resistance of the part. The heat developed in the part can be measured in watts (W). $W=I^2R$. The load inductor is preferably the actual induction heating coil whereby the natural frequency of the two current paths is equal to the driven frequency of the switching circuit. As an alternative, the single inductor is the primary of an output transformer so that the heat controlling driven frequency can be delivered to inductors that are smaller or larger than the nominal inductor. In accordance with another aspect of the present invention the DC current source is the alternator of the engine when the engine is driven and the battery of the engine when the internal combustion engine is not operating.

In accordance with still a further aspect of the present invention the clean DC voltage is preferably in the range of 12 to 24 volts DC which is substantially less than 20 volts and the general upper limit of 50 volts DC. The power supply has a lower input limit of 6 volts DC. In one aspect of the invention, the inductor of the inverter is an induction heating coil. In an other aspect, the inductor is a primary winding of an output transformer having a secondary winding forming the induction heating coil. Although the frequency of the heating system can be as low as 1.0 kHz, it is preferably in the range of 10–20 kHz to drastically reduce this size of those components constituting the inverter. By such high frequency control of the gating circuit, the housing for the inverter can be reduced to substantially less than 100 cubic inches so that it easily fits under the hood of a motor vehicle or the cowling an internal combustion driven implement. The heating system is preferably driven by a switching circuit operated between 10 kHz and 20 kHz. By this high frequency operation, the compactness of the inverter is possible. The advantage of an induction heating system of the type to which the present invention is directed is the ability to operate at a high frequency to produce a relatively low reference depth of heating by the output induction heating coil for efficient heating of related constituents within a very confined compartment.

In accordance with another aspect of the present invention, the gating circuit has a two state counter with an adjustable oscillator for adjusting the driven frequency to tune the actual output heating of the system. In this gating circuit, there are alternate gating pulses with an adjustable dead band between the pulses to operate the first and second switches.

In accordance with another aspect of the present invention, there is a dead time between the pulses to allow the natural frequency of the two combined conductive paths to prepare for reversing of the switches. This is another advantage of using high frequency. The dead time can be reduced between the pulses that control the driven frequency determining the actual heating output of the novel induction heating system.

The primary object of the present invention is the provision of a compact induction heating system that can be mounted in a confined area for diverse operations of induction heating in such confined areas.

Yet another object of the present invention is the provision of a compact induction heating system, as defined above, which compact induction heating system is operated at a high frequency so that it can be mounted in a relatively small housing, such as a housing having a volume of less than about 100 cubic inches.

Still a further object of the present invention is the provision of a compact induction heating system, as defined above, which system utilizes a unique high frequency operated inverter for converting clean DC current to the high frequency heating current. A clean DC current is a current that is not generated by a rectifier and thus has a minimal ripple factor that will adversely effect the operation of the high frequency inverter. Such clean DC is available in an implement or vehicle driven by an internal combustion engine wherein the DC current is generated by an alternator and stored in a battery for use in the emission system of the internal combustion engine.

These and other objects and advantages will become apparent from the following description of the present invention utilizing the accompanying drawings.

BRIEF DESCRIPTION OF THE DRAWINGS

FIG. 1 is a schematic block diagram of the preferred embodiment of the present invention;

FIG. 2 is a schematic block diagram of an embodiment of the invention utilizing the plurality of input batteries in series and an output transformer for the induction coil;

FIG. 3 is a combined wiring diagram and block diagram illustrating in more detail the inverter of the preferred embodiment of the present invention;

FIG. 4 is a gating diagram showing gate pulses for use in the embodiment of the invention shown in FIGS. 3 and 5;

THE PREFERRED EMBODIMENT

Figure 5:
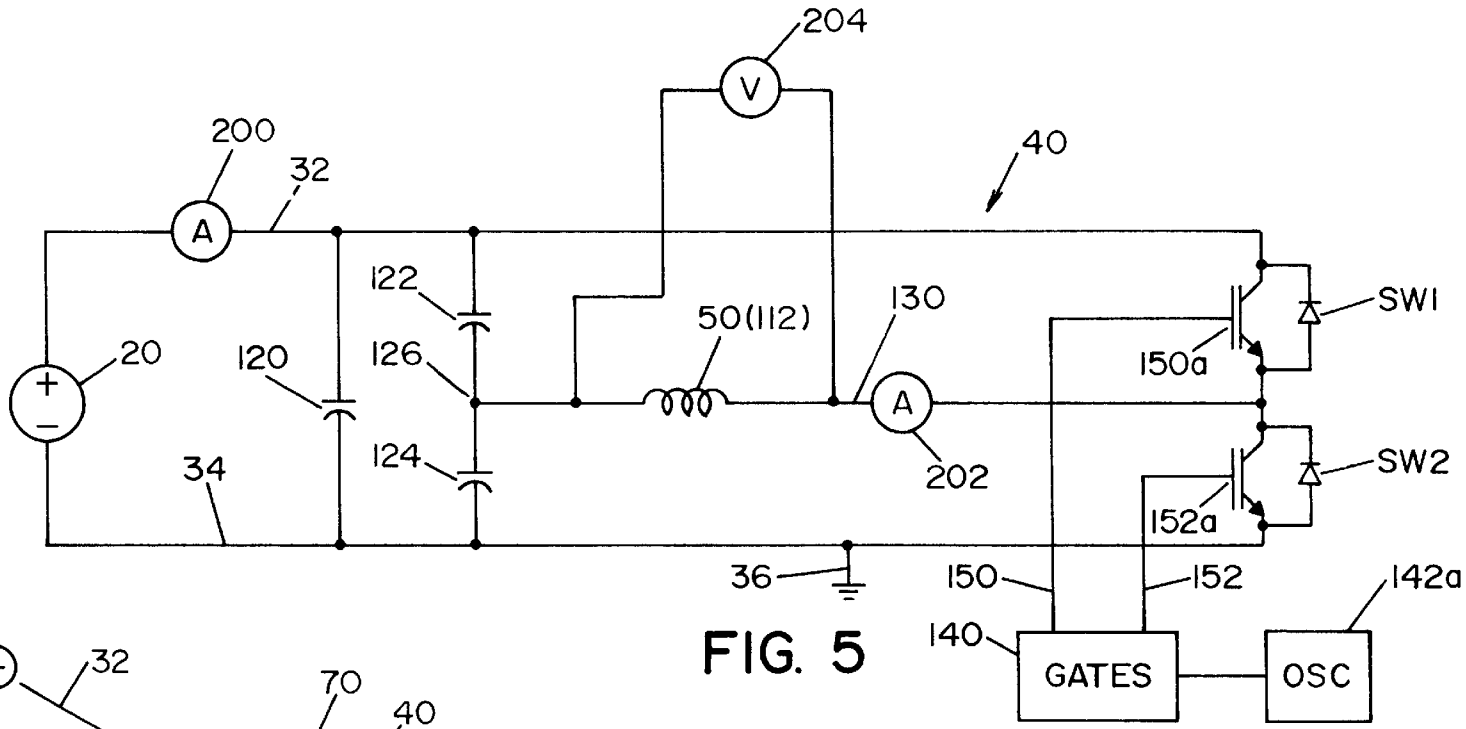
FIG. 5 is a line diagram of the preferred embodiment of the present invention as will be implemented in the practice; and, FIG. 6 is a pictorial view of the small housing used for the high frequency compact inverter contemplated by the present invention.

Referring now to the drawings wherein the showings are for the purpose of illustrating preferred embodiments of the present invention and not for the purpose of limiting the same, FIG. 1 shows an induction heating system A as constructed in accordance with the present invention and used with an internal combustion engine 10 having a standard ignition system 12 whereby alternator 20 is driven by shafts 22 during operation of engine 10. In practice, the output voltage in line 24 is 12 volts DC for storing electrical energy in battery 30 to produce a clean DC current between leads 32, 34. In accordance with standard practice, the negative lead 34 is grounded at terminal 36. By this architecture, the ignition system is powered by a clean DC current directed to ignition system 12 by lead 38 connected to positive lead 32. A novel high frequency inverter 40, the details of which will be explained later, produces high frequency currents to an induction heating coil 50 for inducing a voltage in work piece 60 located in or adjacent to the coil 50. System A does not require an input rectifier and converts clean DC current to a driven frequency preferably in a range of 10–20 kHz. In this manner, the inverter utilizes small electrical components and is sized to be contained within housing 70 illustrated in FIG. 6. Housing 70 has a height a, width b, and a length c to define the volume which is less than 100 cubic inches. In practice, dimension a and dimension b are both about 3 inches. Dimension c is 6 inches. This produces a volume of less than 60 cubic inches. Housing 70 has flanges 72, 74 with mounting holes 76 to mount the housing in restricted areas, such as the side support structure under the hood of a motor vehicle. In this manner induction heating coil is available for performing diverse heating functions under the hood of a vehicle utilizing an internal combustion engine without the size restraints associated with previous induction heating systems. An alternative to the preferred embodiment shown in FIG. 1 is illustrated in FIG. 2 wherein the clean DC current in lines 32, 34 is provided by a plurality of storage batteries illustrated as three batteries 100, 102 and 104 connected in senes. Consequently, the voltage across leads 32, 34 is three times the voltage of each storage battery. In practice, the batteries are 12 volts to develop 36 volts across leads 32, 34. Of course, the batteries could be grouped in different numbers or could be connected in parallel. When connected in parallel, a voltage across leads 32, 34 is the voltage of each battery, but the energy available for the heating operation is multiplied. In all instances, the voltage is less than 50 volts DC and preferably less than 24 volts DC. In practice, the voltage is 12 to 24 volts DC with a lower limit of 6V DC. In FIG. 1 induction heating coil 50 heats work piece 60 directly. In the illustrated alternative embodiment of FIG. 2, the output of the inverter is transformer 110 with primary winding 112. The secondary winding 50' inductively heats load 60.

In the second embodiment, the use of the transformer allows the use of inductors that are smaller and larger than the inductor used in the first embodiment. The use of different sized inductors may be necessary to accommodate various sizes of parts to be heated.

Figure 6:
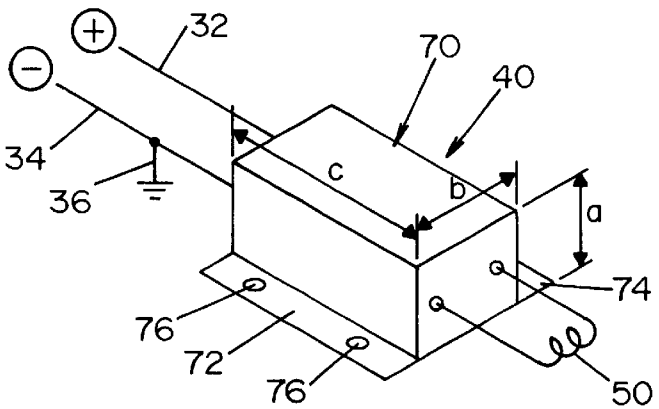

Referring now to FIG. 3, a half bridge inverter network is illustrated with a center tap capacitor branch. The half bridge inverter 40 includes an input filter capacitor 120 with series mounted capacitors 122, 124 defining center tap 126. A common branch 130 is composed of the induction heating coil 50 (112). A pair of solid state switches 150*a* and 152*a* (i.e. IGBT transistors) are also connected in series across the clean DC source 30 and in parallel with the two series AC capacitors 122 and 124. The other end of the inductor is connected to the center junction of the two switches 150*a* and 152*a*. The switches 150*a* and 152*a* are opened and closed (gated on and off) alternately at a frequency determined by the application (typically between 10 kHz and 20 kHz, but with a range capability of 1 kHz to 200 kHz). The frequency of the gates is equal to the natural resonant frequency of the load 50. The power of the amount of heat generated can be varied by slightly adjusting the gating frequency above or below the natural resonant frequency of the load 50. When the first switch 150*a* closes, the voltage stored in the first AC capacitor 124 is discharged through the inductor 50, producing one half of the AC sinusoidal current, and back to the opposite polarity of the clean DC source 32. At the same time, the first capacitor 124 is then charged to the full potential of the clean DC source 30. The switch 150*a* is then opened (turned off), and after a sufficient amount of dead time has elapsed, the second switch 152*a* is turned on. When the second switch 152*a* is closed, the second AC capacitor 122 then discharges through the inductor 50, producing the other half of the AC sinusoidal current, and is then charged to the full potential of the clean DC source 30, but in the opposite polarity of the other capacitor 122. This process is then repeated as long as the gate signals are present. The subsequent cycles after the first cycle differ in the fact that the AC tuning capacitors are now charged to the full potential of the clean DC input. Gating circuit 140 causes alternate gating pulses in gate lines 150, 152. The frequency of these alternation of gating pulses is controlled by the oscillator of driving two state counter 142. The counter produces pulses in opposite directions and is a circuit like a flip-flop or other similar circuit to produce pulses 150, 152 as shown in FIG. 4. These pulses are separated by a distance or time (e) defining a dead time between gating pulses to allow the high frequency components of inverter 40 to transition into a condition awaiting reversal of current flow in branch 130. Since the frequency from gating circuit 140 is normally between 10 and 20 kHz, the components of inverter 40 are quite small and can be mounted into housing 70 as shown in FIG. 6.

The system comprises a high frequency inverter with an input connected to the clean DC source. A pair of identical AC tuning capacitors are connected in series across the clean DC source. Each capacitor is initially charged to one half the input DC voltage. The load inductor is connected at one end to the center junction of the two AC capacitors. A pair of solid state switches (i.e. IGBT transistors) are also connected in series across the clean DC source and in parallel with the two series AC capacitors. The other end of the inductor is connected to the center junction of the two switches. The switches are opened and closed (gated on and off) alternately at a frequency determined by the application (typically between 10 kHz and 20 kHz, but with a range capability of 1 kHz to 200 kHz). The frequency of the gates is equal to the natural resonant frequency of the load. The power of the amount of heat generated can be varied by slightly adjusting the gating frequency above or below the natural resonant frequency of the load. When the first switch closes, the voltage stored in the first AC capacitor is discharged through the inductor, producing one half of the AC sinusoidal current, and back to the opposite polarity of the clean DC source. At the same time, the first capacitor is then charged to the full potential of the clean DC source. The switch is then opened (turned off), and after a sufficient amount of dead time has elapsed, the second switch is turned on. When the second switch is closed, the second AC capacitor then discharges through the inductor, producing the other half of the AC sinusoidal current, and is then charged to the full potential of the clean DC source, but in the opposite polarity of the other capacitor. This process is then repeated as long as the gate signals are present. The subsequent cycles after the first cycle differ in the fact that the AC tuning capacitors are now charged to the full potential of the clean DC input. The process is halted when the gating signals are removed or disabled. The AC current generated by the capacitor-transistor switching system (inverter) is passed though the inductor. This current induces a voltage within the part/workpiece to be heated (via magnetic flux). The induced voltage develops a current within the part which meets resistance to the material which comprises the part. This resistance to current flow generates heat form of $I^2R$ losses, where (I) is the induced current and (R) is the resistance of the part. The heat developed in the part can be measured in watts (W). $W=I^2R$.

A more detailed layout of inverter 40 is illustrated in FIG. 5 where alternator 20 powers the inverter during operation of internal combustion engine 10. Switches SW1, SW2 are IGBT switches having gating terminals 150*a*, 152*a* controlled by pulses 150, 152, as shown in FIG. 4. The IGBT switches can be changed to Mosfet switches for higher frequencies. The frequency of oscillator 142*a* is adjusted to control the heating at induction heating coil 50 (112). One half cycle of AC current flows in a first conductive path when switch SW1 is closed and switch SW2 is opened. The opposite one half cycle of AC current flows in the second path when the switches are reversed. Common branch 130 is a part of both conductive paths. Current in lead 32 is read by DC amp meter 200 and is compared with the current in branch 130 measured by AC amp meter 202. The voltage across load coil 50 is measured by volt meter 204 to determine the relationship between the reversed current flow in branch 130. Meters 200, 202, and 204 shown in FIG. 5 are for the purposes of monitoring the operation of inverter 40 prior to packaging the inverter in housing 70 shown in FIG. 6. The components illustrated in FIG. 5, in practice, are as follows:

| | |
|---|---|
| Capacitor 120 | 100 μF |
| Capacitor 122 | 7.5 μF |
| Capacitor 124 | 7.5 μF |
| Coil 50 | 108 μH |

The readings of the meters shown in FIG. 5 is as follows:

| | |
|---|---|
| Meter 200 | 10–34 amperes DC |
| Meter 202 | 33–102 amperes AC |
| Meter 204 | 17–60 volts AC |

The present involves a small power supply operated by a 12 volt DC input current using a gating card. The small induction heating unit is mounted under the hood of an internal combustion driven vehicle. The inverter is an IGBT based solid state induction heating power supply capable of operating at a relatively low DC bus voltage in the neighborhood of 12–42 volts DC. The switches are No. SK 260MB10 by Semikron rated at 180 amperes and 100 volts. The switches can be Mosfets. The power supply's main design feature is that it can obtain the necessary power from a standard automobile alternator. The induction heating source does not require an AC voltage as required by standard induction heating installations. Any "clean" DC supply will work to power the inverter. In practice, the supply is an alternator or batteries. It could also be operated by solar cell or a fuel cell. From the DC source the power supply will convert the DC voltage to a single phase high frequency DC voltage at approximately 20 kHz. The power supply is not necessarily limited to a specific frequency. A general range of 1.0 kHz to 200 kHz has been used. When making this frequency adjustment, component changes may be made to adjust the operating frequency of the power supply. The power supply is capable of delivering power up to 1500 watts on a 42 volt DC input voltage. The amount of power can be increased or decreased based upon the amount of input voltage or the frequency of the power supply. Typically the frequency is fixed, but the operating frequency may be adjusted above or below the resonant frequency of the load to reduce the amount of output power. The size of the unit is quite compact and it is air cooled, not requiring any fan. The amount of heat is varied by the frequency of the gating pulses. Of course, heating can be varied by duty cycle operation of induction heating system A.

To best define the invention, the following is claimed:

1. A compact induction heating system for use on an internal combustion engine driven implement having an engine driven alternator to generate DC current for storage in a battery used as a source of clean DC current of less than 50 volts for ignition of fuel in said engine, said system comprising a high frequency inverter with an input connected to said clean DC current source, a first current conductive path including a first capacitor and a first switch closed to cause one half cycle of AC current to flow in said first path by discharging said first capacitor, a second current conductive path including a second capacitor and a second switch closed to cause a second half cycle of AC current to flow in said second path by discharging said second capacitor, a single load inductor in both of said paths with AC current flowing in a first direction through said inductor when said first switch is closed and in a second opposite direction through said inductor when said second switch is closed and a gating circuit to alternately close said switches at a driven frequency that is between 10 KHz and 20 KHz to control heating by said load inductor, each of said paths having a given natural frequency and said driven frequency being adjustable to a value near the natural frequency of said load, said high frequency inverter being contained in a housing having a volume of substantially less than 100 cubic inches, and an air cooling system, said air cooling system being a natural air cooling system without the use of cooling fans.

2. An induction heating system as defined in claim 1 wherein said voltage is less than 24 volts.

3. An induction heating system as defined in claim 2 wherein said inductor is an induction heating coil.

4. An induction heating system as defined in claim 2 wherein said inductor is a primary winding of an output transformer having a secondary winding in the form of an induction heating coil.

5. An induction heating system as defined in claim 4 wherein said driven frequency is adjustable between a value less than said natural frequency and a value greater than said natural frequency.

6. An induction heating system as defined in claim 5 including an adjustable counter for adjusting said driven frequency to control the heat output of said system.

7. An induction heating system as defined in claim 2 including an adjustable counter for adjusting said driven frequency to control the heat output of said system.

8. An induction heating system as defined in claim 7 wherein said gating circuit includes a circuit which creates alternate gate pulses for said first and second switches with a dead time between said gate pulses.

9. An induction heating system as defined in claim 1 wherein said voltage is in the general range of 6–24 volts DC.

10. An induction heating system as defined in claim 9 wherein said inductor is an induction heating coil.

11. An induction heating system as defined in claim 9 wherein said inductor is a primary winding of an output transformer having a secondary winding in the form of an induction heating coil.

12. An induction heating system as defined in claim 11 wherein said driven frequency is adjustable between a value less than said natural frequency and a value greater than said natural frequency.

13. An induction heating system as defined in claim 12 including an adjustable counter for adjusting said driven frequency to control the heat output of said system.

14. An induction heating system as defined in claim 9 including an adjustable counter for adjusting said driven frequency to control the heat output of said system.

15. An induction heating system as defined in claim 14 wherein said gating circuit includes a circuit which creates alternate gate pulses for said first and second switches with a dead time between said gate pulses.

16. An induction heating system as defined in claim 1 wherein said inductor is an induction heating coil.

17. An induction heating system as defined in claim 16 including an adjustable counter for adjusting said driven frequency to control the heat output of said system.

18. An induction heating system as defined in claim 1 wherein said inductor is a primary winding of an output transformer having a secondary winding in the form of an induction heating coil.

19. An induction heating system as defined in claim 18 wherein said driven frequency is adjustable between a value less than said natural frequency and a value greater than said natural frequency.

20. An induction heating system as defined in claim 19 wherein said inductor is an induction heating coil.

21. An induction heating system as defined in claim 20 including an adjustable counter for adjusting said driven frequency to control the heat output of said system.

22. An induction heating system as defined in claim 21 wherein said gating circuit includes a circuit which creates alternate gate pulses for said first and second switches with a dead time between said gate pulses.

23. An induction heating system as defined in claim 20 wherein said gating circuit includes a circuit which creates alternate gate pulses for said first and second switches with a dead time between said gate pulses.

24. An induction heating system as defined in claim 19 including an adjustable counter for adjusting said driven frequency to control the heat output of said system.

25. An induction heating system as defined in claim 1 including an adjustable counter for adjusting said driven frequency to control the heat output of said system.

26. An induction heating system as defined in claim 25 wherein said gating circuit includes a circuit which creates alternate gate pulses for said first and second switches with a dead time between said gate pulses.

27. An induction heating system as defined in claim 1 wherein said gating circuit includes a circuit which creates alternate gate pulses for said first and second switches with a dead time between said gate pulses.

* * * * *